US005522588A

United States Patent [19]

Soltysiak

[11] Patent Number: 5,522,588

[45] Date of Patent: Jun. 4, 1996

[54] LINERLESS LABEL STACKING

[75] Inventor: John R. Soltysiak, Blasdell, N.Y.

[73] Assignee: Moore Business Forms, Inc., Grand Island, N.Y.

[21] Appl. No.: 399,620

[22] Filed: Mar. 7, 1995

[51] Int. Cl.[6] ..... B65H 39/02; B65G 57/00; B32B 31/00

[52] U.S. Cl. ..... 270/58.07; 414/790.4; 156/289; 156/512; 156/558

[58] Field of Search ..... 270/58; 271/314, 271/315, 187, 292, 207; 414/790.4; 156/289, 512, 558, 567, 568, 572

[56] References Cited

U.S. PATENT DOCUMENTS

| | | | |
|---|---|---|---|
| 3,502,321 | 3/1970 | McWhorter | 270/58 |
| 4,145,038 | 3/1979 | Mol | 270/58 |
| 4,678,179 | 7/1987 | Edwards et al. | 271/315 X |
| 4,743,319 | 5/1988 | Ramcke | 156/512 X |
| 4,925,173 | 5/1990 | Lindblom et al. | 270/58 X |
| 4,955,964 | 9/1990 | Hain . | |
| 5,083,998 | 1/1992 | Carter . | |
| 5,104,282 | 4/1992 | Gleason . | |
| 5,398,919 | 3/1995 | Suter | 270/58 |

*Primary Examiner*—John E. Ryznic
*Attorney, Agent, or Firm*—Nixon & Vanderhye

[57] ABSTRACT

A linerless label stacking assembly and procedure utilize a paddle wheel first conveyor having a rotatable central portion with a number of paddles extending generally radially outward from the central portion. The central portion is along a generally horizontal axis and is rotated about that axis at spaced time intervals in a first direction. Each paddle has first and second curved surfaces which engage the linerless labels for stacking. A second conveyor having a generally horizontal supporting surface is disposed at approximately the same vertical position as the first conveyor axis, and a rotary cut off device, or a similar individual label cutter, feeds linerless labels to the first conveyor one at a time. After a stack of predetermined size is formed on a paddle, a controller (which receives input from a sensor associated with the rotary cut off) controls motors to rotate the first conveyor and operate the second conveyor to advance a stack of labels away from the cut off device.

20 Claims, 2 Drawing Sheets

LINERLESS LABEL STACKING

BACKGROUND AND SUMMARY OF THE INVENTION

Linerless labels are becoming increasingly popular due to the environmental and cost advantages associated with them. While such labels are typically provided in roll form, there are many situations in which it is desirable to provide them in pad form instead of roll form. In order to effectively and quickly construct pads it is desirable to form the linerless labels in web form, then separate each individual label from the web in a high speed manner, form stacks, and move the stacks away from the individual label forming position.

According to the present invention a method and apparatus are provided which allow the rapid and efficient formation of pads of linerless labels. Linerless labels have a first surface with an adhesive release material thereon, such as silicone. The first surfaces are typically also printed with indicia, or indicia is otherwise applied, either on top of the adhesive release material on the substrate of the label itself (typically paper although plastic and other sheet materials can also be utilized). On the second, opposite, face of the label is a pressure sensitive adhesive, which may be a permanent, removable, or releasable adhesive. The adhesive cannot permanently stick to the adhesive release material on the first face of an adjacent (in a stack) label, but rather the labels may be readily separated from each other in the stack. In this way no separate release sheets that need be disposed of are provided, resulting in significant savings in material, and landfill space.

According to a first aspect of the present invention a method of stacking linerless labels in a pad, utilizing a paddle wheel first conveyor and a second conveyor downstream from the first conveyor in a first direction, is provided. The method comprises the following steps: (a) Substantially continuously transporting the individual linerless labels one at a time in the first direction into supporting contact with a generally horizontal paddle of the first conveyor, to form a stack of at least three linerless labels with the first surface of one label engaging the second surface of an adjacent label in the stack. (b) After formation of a stack of linerless labels moving the first conveyor by rotating the paddles thereof so that the stack is elevated, and a new paddle comes into a generally horizonal position to receive linerless labels in a stack. (c) As steps (a) and (b) are practiced, ultimately rotating the paddles of the first conveyor so that a paddle supporting a stack of linerless labels moves below a transporting surface of the second conveyor, so that the second conveyor supports the stack of linerless labels. And, (d) transporting the stack of linerless labels supported by the second conveyor away from the first conveyor.

Step (d) may be practiced intermittently, in synchronous movement with the rotation of the first conveyor in step (b). There is typically also the further step of simultaneously cutting (detaching, or otherwise separating) individual labels from a web during the practice of step (a). The second conveyor movement, as well as the rotation of the paddles, is typically practiced as a result of information supplied from a sensor associated with the cut off or detaching mechanism.

According to another aspect of the present invention a linerless label stacking assembly is provided which comprises the following elements: A paddle wheel first conveyor having a rotatable central portion with a plurality of paddles extending generally radially outwardly from the central portion; the central portion along a generally horizontal axis. Means for, at spaced time intervals, rotating the first conveyor about the axis in a first direction. A second conveyor having a generally horizontal supporting surface disposed at approximately the same vertical position as the first conveyor generally horizontal axis. And, means for feeding linerless labels, each having a first adhesive release surface and a second pressure sensitive adhesive surface, to the first conveyor one at a time.

Each of the paddles of the first conveyor may have first and second curved surfaces, each surface having a first end adjacent the central portion and a second, free, end remote from the central portion. The first and second curved surfaces may have the same general direction of curvature, and the first surface is typically concave as viewed in the first direction of rotation.

The means for rotating the first conveyor may comprise a D.C. motor, or another power source such as an A.C. motor, pneumatic, hydraulic, or similar type of power source which is controlled by a controller. The controller receives sensing information which indicates when a pad of a predetermined size (typically at least three linerless labels) has been formed to effect rotation of the paddle wheel so that the next paddle comes into operative association with the feeding means.

The second conveyor may comprise a wide variety of different types of conveyors, such as belt, chain., flat horizontal surfaces guided and supported by moving elements, or a wide variety of other conventional types. One particularly suitable type is that comprising a flexible element (such as a belt or chain) having a top surface and with push arms extending outwardly from the surface for pushing pads of labels thereon away from the first conveyor.

The means for feeding linerless labels to the first conveyor may comprise roller, belt, or other conventional type conveyors and may also comprise means for separating the individual labels from a web, i.e. a cut off device. For example a rotary cut off device having first and second rotating cylinders, rotatable about generally parallel generally horizontal axes, and one having a radially extending cutting blade and the other an anvil cylinder, and having a sensor associated therewith, may be provided for simultaneously conveying a label web toward the first, paddle wheel, conveyor and simultaneously cutting it (the web) into individual labels. Alternatively the cut off device may comprise a burster for bursting the web along predetermined lines of weakness, or a wide variety of other separating devices may be utilized including scissors, guillotine, thermal, laser, and other types of cutters.

According to another aspect of the invention a paddle wheel conveyor is provided comprising the following elements: A rotatable central portion along a generally horizontal axis. A plurality of paddles extending generally radially outwardly from the central portion. Each paddle having first and second curved surfaces, each surface having a first end adjacent the cental portion and a second, free, end remote from the central portion. And, means for, at spaced time intervals, rotating the central portion about the axis in a first direction.

It is the primary object of the present invention to provide a quick and effective method, apparatus, and paddle wheel type conveyor, for forming linerless labels into pads. This and other objects of the invention will become clear from an inspection of the detailed description of the invention, and from the appended claims.

DETAILED DESCRIPTION OF THE DRAWINGS

Figure 1:
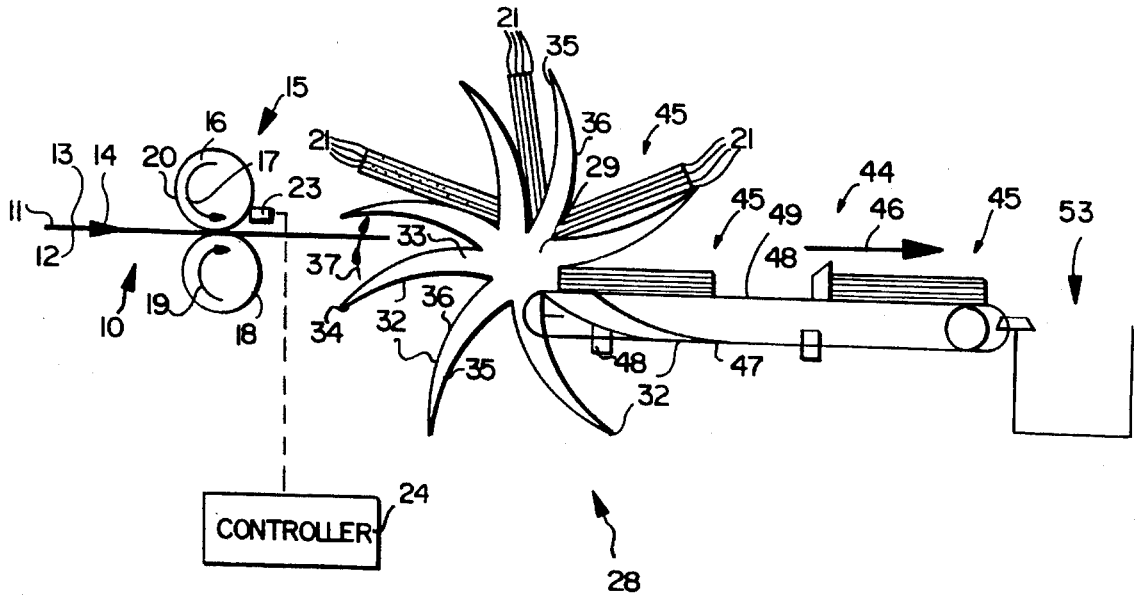
FIG. 1 is a side schematic view of an exemplary linerless label pad stacking assembly according to the present invention.

FIG. 1 schematically illustrates a web 10 of linerless label material which is produced on line at high speed. The web 10 typically includes a substrate 11, e.g. of paper, as well as a first surface 12 of adhesive release material such as silicone, and a second surface 13 coated with pressure sensitive adhesive. The pressure sensitive adhesive may be of any type and tackiness (e.g. permanent, removable, releasable, etc.), just so that it does not permanently adhere to the adhesive release material 12. The particulars of the linerless labels per se are not part of the present invention, but almost any type of conventional linerless labels may be utilized.

The web 10 moves in the first direction, as indicated by arrow 14 in FIG. 1. It may be pulled in that direction by a feeding or transporting means shown generally by reference numeral 15. In this case the means 15 includes a first cylinder 16 rotatable in direction 17 about a generally horizontal axis, and a second cylinder 18 rotatable in direction 19 also about a generally horizontal axis, parallel to the axis of the roller 16. The rollers 16, 18 typically engage the web 10 and move it in the direction 14. In the embodiment illustrated in FIG. 1 the cylinder 16 has a cutting blade 20 associated therewith and the cylinder 18 (the hardened steel exterior periphery thereof) serves as an anvil cylinder to cut the web 10 into individual labels, shown in a stack of four labels 21 to the right of the apparatus 15 in FIG. 1, is that the apparatus 15 also includes a cut off device.

Instead of the rollers 16, 18 a wide variety of other feeding means could be provided such as belt type conveyors, other types or sets of rollers, sheet feeders, or the like. Also instead of providing a severing action the cut off device or mechanism 15 may feed preformed sheets, or may provide a bursting action bursting the web 10 along predefined lines of weakness (such as perforations). Other types of knife cutters, or thermal or laser cutters, can be used.

A sensor, such as an optical sensor shown schematically at 23 in FIG. 1, may be provided associated with the mechanism 15 for "counting" each of the individual labels 21 that are separated from the web 10, or otherwise fed by the mechanism 15. For example the sensor 23 may sense each rotation of the blade 20, or may otherwise be shaft encoded. The sensor 23 supplies information to a conventional computer controller 24 or the like. Of course one or both of the rolls 18, 16 are typically powered, as by a conventional electric motor 25 (see FIG. 2).

Downstream of the mechanism 15 in the direction 14 is a first, paddle wheel type conveyor 28. The conveyor 28 includes a central portion, or shaft, 29 which is mounted (e.g. by conventional bearings, not shown) for rotation about a generally horizontal axis, such as the axis 30 seen in FIG. 2. The axis 30 is parallel to the axes of the rollers 16, 18.

Connected to the central portion 29 are a plurality of paddles 32 each having a first end 33 adjacent (typically connected to) the central portion. 29, and a second, free, end 34 most remote from the central portion. 29. As illustrated in FIG. 1, each of the paddles 32 may have first and second curved surfaces 35, 36, respectively. The surfaces 35, 36 have generally the same direction of curvature, as can be seen in FIG. 1. That is both surfaces 35, 36 are not concave or convex. The central portion 29 is rotated in the direction of arrow 37 when it is moved, and the first surface 35 is concave when viewed in the first direction of rotation 37, while the second surface 36 is convex.

The provision of the curved surfaces 35, 36 performs a number of functions. Since the surfaces are curved there will be a smaller area thereof in contact with the adhesive surface 13 of the linerless labels than if the paddles were flat. This allows more ready transfer of the linerless label stacks from one position to the next as the conveyor 28 is rotated in direction 37 and minimizes the chance of the adhesive 13 sticking to the conveyor 28. However to further minimize the possibility of sticking one or both of the surfaces 35, 36 may be coated with an adhesive release material, such as silicone, or other smooth material such as polytetrafluoroethylene. Both of the surfaces 35, 36 may be coated so that the conveyor 28 may be rotated in either direction, and/or may be associated with linerless labels regardless of the orientation of the surfaces 12, 13 when the labels 21 are fed to the conveyor 28 (although the particular orientation and configuration of FIG. 1 is preferred).

Figure 2:
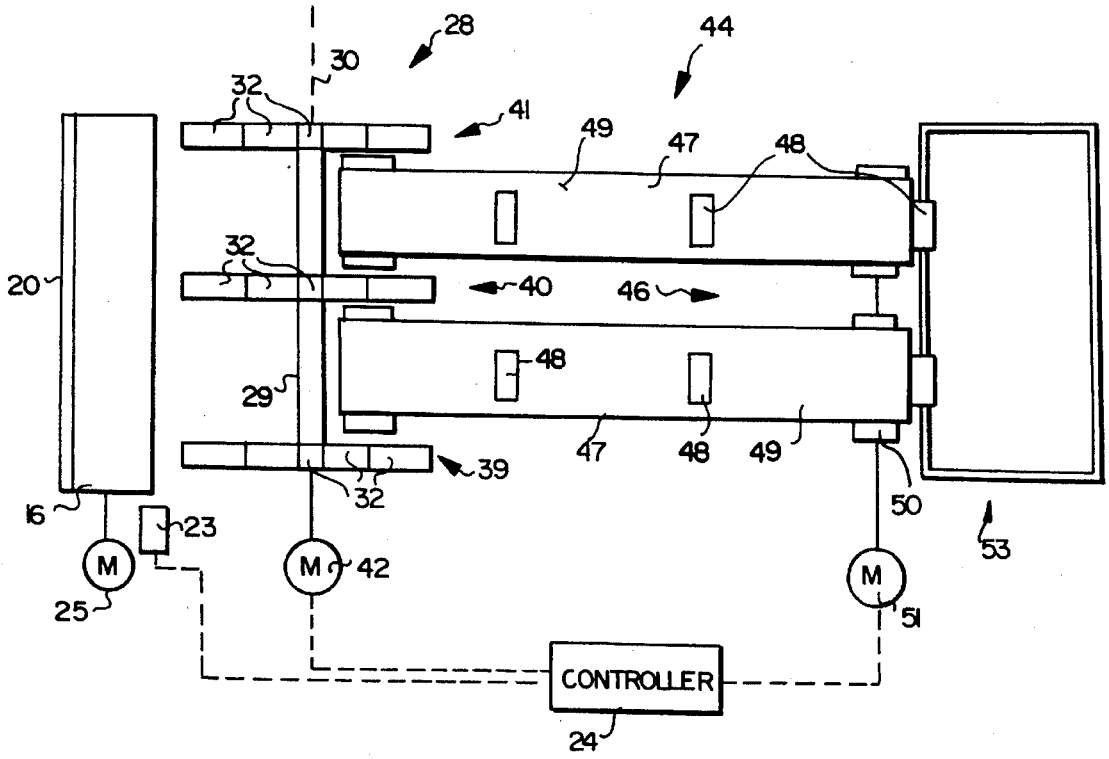
FIG. 2 is a top plan schematic view of the assembly of FIG. 1 witch the web of linerless label material and individual linerless labels removed for clarity of illustration.

In the embodiment illustrated in FIG. 2, the central portion 29 of the conveyor 28 is continuous, but the paddles 32 are provided as a plurality of distinct elements, shown in FIG. 2 as three distinct sets of elements generally by reference numerals 39, 40, and 41. The central portion 29 is rotated in direction 37 by a power source 42, which may be a D.C. motor, A.C. motor, pneumatic, hydraulic, or other type of conventional power source, typically controlled by the controller 24. The motor 42 typically rotates the central portion 29 in direction 37 at spaced time intervals (e.g. intermittently or periodically). Typically after a stack of sufficient size, at least three, of linerless labels has been formed, the motor 42 rotates the shaft 29 in the direction 37 an arcuate extent corresponding generally to the spacing between two paddles 32, so that the second surface 36 of the next paddle 32 in the direction of rotation 37 is disposed generally horizontally to receive the next linerless label 21 being fed by the device 15.

Feeding action of the linerless labels 21 to the conveyor 28 is typically substantially continuously, although it can be arrested slightly during initial rotation of the central portion 29 of conveyor 28 until the next paddle 32 is in proper position.

Also, typically operated intermittently or periodically (at spaced time intervals) in synchronism with the first conveyor 28 is a second conveyor, shown schematically by reference numeral 44 in FIGS 1 and 2. The second conveyor 44 may comprise any device that can move the stacks 45 of linerless labels 21 that have been formed away from the first conveyor 28, typically in the direction 46 (which is generally coincident with direction 14). While all sorts of belt, chain, flat surface, and like conventional conveyors may be utilized, in the embodiment illustrated in FIGS. 1 and 2 the second conveyor 44 comprises an endless loop (or spaced endless loops) 47 of any suitable flexible material. For example the material 47 may be a belt. Pusher arms 48 are provided along the belt or belts 47 spaced from each other in the direction 46, at least the dimension of a stack 45 of linerless labels to be deposited thereon. The stacks 45 are placed into contact with the top surface (exterior surface) 49 of the belt or belts 47.

The belt or belts 47 may be powered by rotating a shaft 50 at one end thereof with a suitable power source 51

(comparable to the power source 42) also controlled by the controller 24. As earlier indicated it is desirable to move the conveyors 29, 44 in synchronism so that when the paddles 32 start rotating in direction 37 the shaft 50 is rotated to move the surfaces 49 in direction 46 with the pusher arms 48 engaging a stack or stacks 45 to move them away from the conveyor 28 so that the next stack 45 may be laid down. Ultimately the endless loop 47 ends and the stack 45 is deposited in some other mechanism, merely shown schematically as a bin or like collection device 53 in FIGS. 1 and 2.

Depending upon whether the adhesive or release material surface of the linerless labels 21 will be brought into contact with the surfaces 49, they either may or may not be coated with an adhesive release material, such as silicone, or the like.

It will thus be seen that according to the present invention a simple yet effective method, apparatus assembly, and conveyor, have been provided for facilitating the stacking of linerless labels. While the invention has been herein shown and described in what is presently conceived to be the most practical and preferred embodiment thereof it will be apparent to those of ordinary skill in the art that many modifications may be made of the invention, which scope is to be accorded the broadest interpretation of the appended claims so as to encompass all equivalent structures and procedures.

What is claimed is:

1. A method of stacking linerless labels in a paid, each label comprising a first surface having adhesive release material thereon and a second surface having a pressure sensitive adhesive, utilizing a paddle wheel first conveyor and a second conveyor downstream from the first conveyor in a first direction, said method comprising the steps of:

(a) substantially continuously transporting the individual linerless labels one at a time in the first direction into supporting contact with a generally horizontal paddle of the first conveyor, to form a stack of at least three linerless labels with the first surface of one label engaging the second surface of an adjacent label in the stack;

(b) after formation of a stack of linerless labels moving the first conveyor by rotating the paddles thereof so that the stack is elevated, and a new paddle comes into a generally horizonal position to receive linerless labels in a stack;

(c) as steps (a) and (b) are practiced, ultimately rotating the paddles of the first conveyor so that a paddle supporting a stack of linerless labels moves below a transporting surface of the second conveyor, so that the second conveyor supports the stack of linerless labels; and (d) transporting the stack of linerless labels supported by the second conveyor away from the first conveyor.

2. A method as recited in claim 1 wherein step (d) is practiced intermittently in synchronous movement with the rotation of the first conveyor in step (b).

3. A method as recited in claim 1 comprising the further step of simultaneously with the practice of step (a) cutting a web of linerless labels into individual linerless labels just prior to passage thereof into contact with the generally horizontal paddle of the first conveyor.

4. A method as recited in claim 3 comprising the further step of sensing each individual label cutting action and utilizing the sensed information to determined whether a sufficient stack of linerless labels, pursuant to step (b), has been formed so as to initiate step (b).

5. A method as recited in claim 4 wherein step (d) is practiced intermittently in synchronous movement with the rotation of the first conveyor in step (b).

6. A method as recited in claim 3 wherein said cutting step is practiced by utilizing a pair of rotating cutting elements, one having a cutting blade, and the other serving as an anvil, by rotating the cutting elements in opposite directions about parallel generally horizontal axes.

7. A method as recited in claim 1 wherein step (d) is practiced by conveying the stack of linerless labels away from the first conveyor using a second conveyor, the paddles of the first conveyor depositing the stack of linerless labels on a conveyance surface of the second conveyor.

8. A method as recited in claim 7 wherein step (d) is practiced intermittently in synchronous movement with the rotation of the first conveyor in step (b).

9. A linerless label stacking assembly comprising:

a paddle wheel first conveyor having a rotatable central portion with a plurality of paddles extending generally radially outwardly from said central portion; said central portion along a generally horizontal axis;

means for, at spaced time intervals, rotating said first conveyor about said axis in a first direction;

a second conveyor having a generally horizontal supporting surface disposed at approximately the same vertical position as said first conveyor generally horizontal axis; and means for feeding linerless labels, each having a first adhesive release surface and a second pressure sensitive adhesive surface, to said first conveyor one at a time.

10. An assembly as recited in claim 9 wherein each paddle has first and second curved surfaces, each surface having a first end adjacent said central portion and a second, free, end remote from said central portion.

11. An assembly as recited in claim 10 wherein said first and second curved surfaces have the same general direction of curvature.

12. An assembly as recited in claim 11 wherein said first surface is concave when viewed from said first direction.

13. An assembly as recited in claim 9 wherein said means for, at spaced time intervals, rotating said first conveyor comprises a motor and a controller.

14. An assembly as recited in claim 13 wherein said feeding means further comprises a cut off device located on the opposite side of said paddle wheel first conveyor from said second conveyor; and further comprising a sensor associated with said cut off device and connected to said controller for providing input for controlling said motor.

15. An assembly as recited in claim 9 wherein said second conveyor comprises a transport conveyor having an endless loop flexible conveyor element with push arms associated therewith.

16. An assembly as recited in claim 9 further comprising means for, at spaced time intervals, in synchronism with said means for rotating said first conveyor, driving said second conveyor to move a stack of linerless labels away from said first conveyor.

17. An assembly as recited in claim 16 wherein said rotating means and said second conveyor moving means comprise motors controlled by a common controller.

18. A paddle wheel conveyor, comprising:

a rotatable central portion along a generally horizontal axis;

a plurality of paddles extending generally radially outwardly from said central portion;

each paddle having first and second curved surfaces, each surface having a first end adjacent said cental portion and a second, free, end remote from said central portion; and means for, at spaced time intervals, rotating said central portion about said axis in a first direction.

19. A conveyor as recited in claim 18 wherein said first and second curved surfaces have the same general direction of curvature.

20. A conveyor as recited in claim 19 wherein said first surface is concave when viewed from said first direction.

* * * * *